United States Patent [19]

Zabel, Jr.

[11] 4,165,879

[45] Aug. 28, 1979

[54] GOLF GAME

[76] Inventor: William P. Zabel, Jr., 1682 Long Meadow Rd., Fort Myers, Fla. 33907

[21] Appl. No.: 717,915

[22] Filed: Aug. 26, 1976

[51] Int. Cl.[2] ..... A63F 3/00

[52] U.S. Cl. ..... 273/259; 273/186 C

[58] Field of Search ..... 273/87, 87.2, 87.4, 273/134, 186, 81, 183, 245, 259

[56] References Cited

U.S. PATENT DOCUMENTS

| | | | |
|---|---|---|---|
| 1,471,794 | 10/1923 | Leven | 273/186 A |
| 3,018,109 | 1/1962 | Starck | 273/186 R |
| 3,229,980 | 1/1966 | Silberman | 273/186 A |
| 3,376,037 | 4/1968 | Lepselter | 273/26 B |
| 3,453,889 | 7/1969 | Anello | 273/186 A |
| 3,462,156 | 8/1969 | Gentry | 273/186 A |
| 3,679,206 | 7/1972 | Shambaugh | 273/186 C X |

*Primary Examiner*—Richard C. Pinkham
*Assistant Examiner*—R. Carl Moy
*Attorney, Agent, or Firm*—Duckworth, Hobby, Allen & Pettis

[57] ABSTRACT

This invention relates to a parlor game for simulating the sport of golf. The game includes an elongated handle for being grasped and swung by the player. A flexible line is frictionally coupled through an aperture in the handle for providing a centrifugal force indication representative of a forward distance as the player swings the handle. A direction indicator is provided for being struck by the handle, or the player's hands coupled thereto, during the swing for providing a direction indication. A game board is provided which represents a golf course including a tee-off point and a hole point. Markers are provided for representing the position of each player as the hole is played. A converter adapts the indication from the forward distance and the forward direction indicators to provide a distance vector for directing the movement of the markers generally according to the rules of the game of golf.

18 Claims, 5 Drawing Figures

GOLF GAME

BACKGROUND OF THE INVENTION

1. Field of the Invention

This invention relates to golf game simulators, and in particular to an apparatus for simulating and perfecting the golf swing without striking a long distance projectile.

2. Description of the Prior Art

The golf swing, while deceptively simple in its appearance, is composed of a sequence of generally difficult muscular maneuvers which must be accomplished in the proper sequence and with an exacting degree of accuracy to enable the golfer to accurately propel the ball. The speed of the swing which imparts momentum to the projectile and the position and direction of motion of the wrists when the projectile is struck will determine the distance, the direction and the directional aberrations which describe the path of the golf ball as it travels toward the hole. Heretofor in golf simulations, it has been necessary for the golfer to actually strike a fast traveling or long distance projectile in order to determine the distance and path of the ball. However, both swinging a club and striking the projectile within the confines of a normal room have proven to be both dangerous and an inexact method of improving the golf swing.

Examples of golf simulation games contained in the prior art are described in the disclosures of Esposito in U.S. Pat. No. 3,434,722; Davis in U.S. Pat. No. 3,561,272; and Chapman in U.S. Pat. No. 2,986,937. However, these three patents do not include a method for determining the direction of the flight of the projectile after simulating the striking motion. Various other devices for simulating the golf swing are disclosed by Atkinson in U.S. Pat. No. 3,428,325; Silberman in U.S. Pat. No. 3,229,980; Kunihisa in U.S. Pat. No. 3,318,602; and Guier in U.S. Pat. No. 3,113,782. A device for simulating the baseball swing is disclosed by Lepselter in U.S. Pat. No. 3,376,037.

SUMMARY OF THE INVENTION

This invention relates to a parlor game for simulating the outdoor sport of golf. Vector means are provided to determine the distance and direction of the shot relative to the golf hole. The vector means includes an elongated handle for being grasped and swung by the player, resistance means coupled to the elongated handle, and a flexible line movably coupled through the resistance means for providing a centrifugal force indication representative of a forward distance. Forward direction means are provided for being struck by the elongated handle or the back of the player's leading hand during the swing for providing a forward direction indication of the forward distance. A game board is included for representing a golf course having at least one tee off point and one hole point thereon. Markers are provided for representating the position of each player on the game board. The game also includes conversion means for converting the forward distance indication and the forward direction indication to a distance vector for directing the movement of the markers according to the rules of the game.

THE DRAWINGS

Other objects, features and advantages of the present invention will be obvious from a study of the written description and the drawings in which.

DETAILED DESCRIPTION OF THE PREFERRED EMBODIMENT

The parlor golf game incorporates several unique elements which cooperate to simulate the sport of golf. The construction of each of these elements will first be explained and then the cooperation of the elements will be explained as part of the game operation and game rules.

Figure 2:
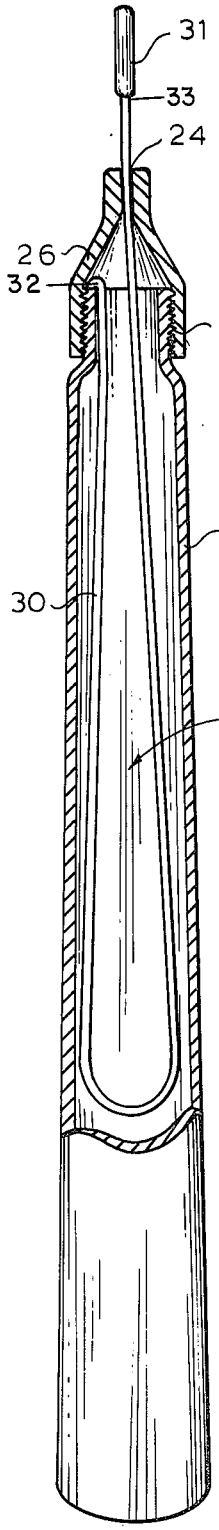
FIG. 2 is a frontal cross-section elevation of the handle having the flexible line coupled thereto.

As illustrated in FIG. 2, the parlor golf game includes an elongated handle 20 having the shape of the typical golf club grip. The handle 20 includes an elongated handle cavity 22 for receiving and storing therein a flexible line 30. The flexible line 30 has a generally circular cross-section which communicates through a generally circular handle aperture 24 located coaxially within a generally conically shaped handle cap 26 coupled by a plurality of threads 27 to an open end of the handle 20. The cross-sectional area and diameter of the flexible line 30 is slightly greater than the cross-sectional area and diameter of the handle aperture 24, thereby providing a circumferential resistance and sliding fit therebetween. A first end of the flexible line 30 extends through the handle aperture 24 and has coupled thereto a generally cylindrical sheath 31 for increasing the mass of the first end section of the flexible line 30 as compared to other sections thereof. A second end 32 of the flexible line 30 is coupled to a neck section of the handle 20 which is contained within and covered by the handle cap 26. The length of the flexible Line 30 is on the same reduced scale as that of the gameboard. It has an equivalent scale length somewhat greater than the distance any player can hit a golf ball, i.e., 350 or 400 yards. The handle 20 and the handle cap 26 may be manufactured of a metallic or plastic substance which may be covered, if desired, with a rubber molding for simulating the typical golf club grip. The flexible line 30 is preferably formed from a woven textile fabric such as a mercerized shoelace-type material or round woven nylon cord.

While only one handle 20 has been shown in FIG. 2, it may be desirable to have available several different handles 20 each representing a different group of clubs in the spectrum of available golf clubs. For example, a first handle 20 may be constructed to provide a relatively loose fit between the flexible line 30 and the handle aperture 24, thereby allowing a relatively long length of the flexible line 30 to pass through the handle aperture 24 for a given centrifugal force created as the handle 20 is grasped and swung by the player. Likewise, a relatively tight fit between the flexible line 30 and the handle aperture 24 may be required for the shorter distance irons, such as the sand wedge, nine iron, eight iron, etc. The other clubs falling between these two ends of the spectrum may be simulated by a third handle 20 in which the flexible line 30 has a sliding fit within the handle aperture 24 of a degree between the aforementioned two extremes. As described above, the cylindrical sheath 31 increases the mass of the first end section. This increased mass outside of the handle aperture 24 increases the amount of centrifugal force applied to the remaining flexible line in the handle cavity 22 to pull it through the handle aperture during the swing. In the game of golf the rules state that the player is allowed to carry a maximum of 14 clubs in his bag. Excluding the putter, there are 13 irons and woods with varying degrees of angle on the club face. Golf professionals say every club on full shots should be swung with the same amount of effort with proper club selection determining the required distance of the shot. If more than one of the handles 20 are used in the game, the weight of sheath 31 can be varied on the different handles in addition to varying the tightness of fit between the flexible line 30 and the handle aperture 24. Thus, a handle can be supplied to simulate in the game each of the clubs used in the actual game of golf. Each handle is marked with the corresponding golf club designation. In the use of these handles, the flexible line 30 may be totally inserted through the handle aperture 24 and into the handle cavity 22 before the player makes his swing.

If one or just several handles are provided in the game, the inner end of the sheath 31 may be pre-set at different distances away from the outer end of aperture 24. The greater the pre-set distance is, the greater is the momentum of the exposed flexible line pulling the remaining line in the handle cavity 22 against the resistance of the remaining line moving through the aperture 24. For comparable effort, the greater the pre-set length is, the greater will be the distance of the shot as indicated by the final exposed length of flexible line 30. Thus a pre-set and handle selection chart can be supplied as shown generally at 65 in FIG. 1. Opposite each golf club designation is marked the distance in yards obtained with that club by the average golfer and the pre-set amount of flexible line 30 to be exposed in order to obtain approximately that distance when the handle is swung properly. The above values in the pre-set and handle selection chart are marked in the same scale proportion at the game board. Preset lengths are measured from this chart.

When the player grasps the handle 20 and swings with the normal golf motion, flexible line 30 will be drawn by centrifugal force through the handle aperture 24. Of course, the length of the flexible line 30 drawn from the handle aperture 24 will depend on the tightness of fit between the flexible line 30 and aperture 24, and the rotational velocity generated by the player during the swing. Therefore, as the player exerts more energy in the swing the centrifugal force will be increased, thus drawing a longer length of the flexible line 30 from the handle aperture 24. Thus, the length of the flexible line 30 drawn from the handle aperture 24 is proportional to the distance which would be traveled by a hypothetical ball after being struck by a hypothetical head coupled to the handle 20.

Figure 4:
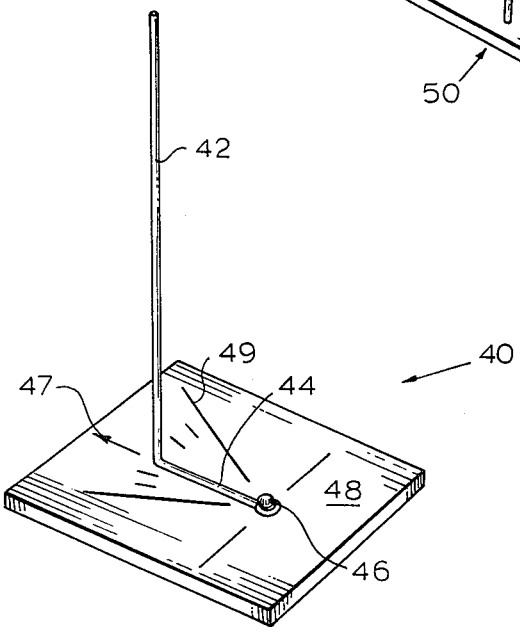
FIG. 4 illustrates a first preferred embodiment of the shot direction indicator.

A first preferred embodiment of a shot direction indicator is illustrated generally as 40 in FIG. 4. The shot direction indicator includes an L-shaped rod having a vertical section 42 coupled at a right angle to a generally horizontal section 44. An enlarged end of the horizontal section 44 is movably coupled by a pivot 46 to a base section 48. The base section 48 contains thereon a single preferred direction line 47 and a plurality of actual direction marks or hypothetical off-line direction marks 49 radiating from the pivot 46. The vertical shaft section 42 is composed of a resilient material which may be deflected in a forward direction, as depicted by the preferred direction line 47, when the vertical shaft section 42 is struck by either the handle 20 or the player's hands coupled around the handle 20 as the player swings through the golf stroke. Since the vertical shaft 42 will deflect in the forward direction, there will be no rotation of the horizontal section 44 about the pivot 46 if the direction of the motion imparted to the vertical section 42 is parallel with the preferred direction line 47. However, if the player swings from the inside out or the outside in, a lateral component of the swing will induce a force perpendicular to the vertical and horizontal shaft sections 42 and 44 thereby rotating the horizontal shaft section 44 about the generally vertical pivot 46. The rotational friction of the pivot 46 is carefully chosen such that the horizontal shaft section 44 will be deflected from the preferred direction line 47 in an amount representative of the lateral component of the swing, but will not continue to rotate about the pivot 46 after the lateral force has been removed. In this manner, after the vertical shaft section 42 has been struck by the swinging motion, the horizontal shaft section 44 will rotate about the pivot 46 and come to rest in a position indicating the presence or absence of a lateral force component of the swing. As the lateral force component increases, the deflection of the horizontal shaft section 44 will increase as indicated by the off-line direction marks 49 in proportion to the degree the player has hit his shot off line.

Figure 5:
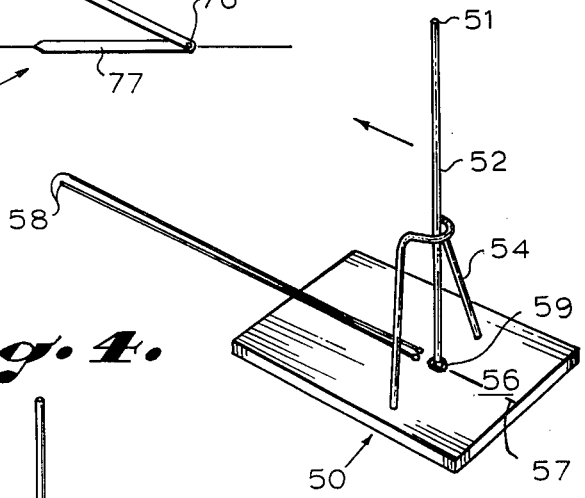
FIG. 5 illustrates a second preferred embodiment of the shot direction indicator.

A second preferred embodiment of the shot direction indicator is illustrated in FIG. 5 as comprising a generally vertical shaft 52 which is supported by a frame 54 coupled to a base 56. The vertical shaft 52 is not coupled to the frame 54 or the base 56 but is free to be propelled by the impact with the handle 20 or the golfer's hands during the golfing swing. A positioning hole 59 is provided in base 56 to insure that shaft 51 is placed in position on the preferred direction line 57. The lateral component present in the swing is determined by measuring the lateral displacement angle at the final resting location between a first end 51 of the vertical shaft 52 and the preferred direction line 57. Ideally, the first end 51 of the vertical shaft 52 will land directly along the preferred direction line 57 when no lateral component is present in the swing, thereby indicating that the golfer would have driven the ball in a straight line without an appreciable hook or slicing action on the flight of the ball.

Two measuring cords 58 (which are equal half lengths of a length of cord stapled at its midpoint to base 56) are attached to base 56 and are initially extended along the preferred direction line 57. These cords are an aid to the player in taking his stance so that he may better swing his hands and handle 20 along the preferred direction line 57 while making contact with the shot direction indicator 50. When the vertical shaft 52 is struck, it flies out of positioning hold 59. The bottom leading edge of the indicator slides over the top edge of the positioning hole. When the first end 51 of the vertical shaft 52 does not land in line with the preferred direction line 57, one of the measuring cords 58 nearest the first end 51 of the vertical shaft is moved so that it extends over this end 51 of the shaft and thereby indicates the lateral displacement angle of the swing as that angle between the two cords 58 at their pivot point on base 50.

Figure 1:
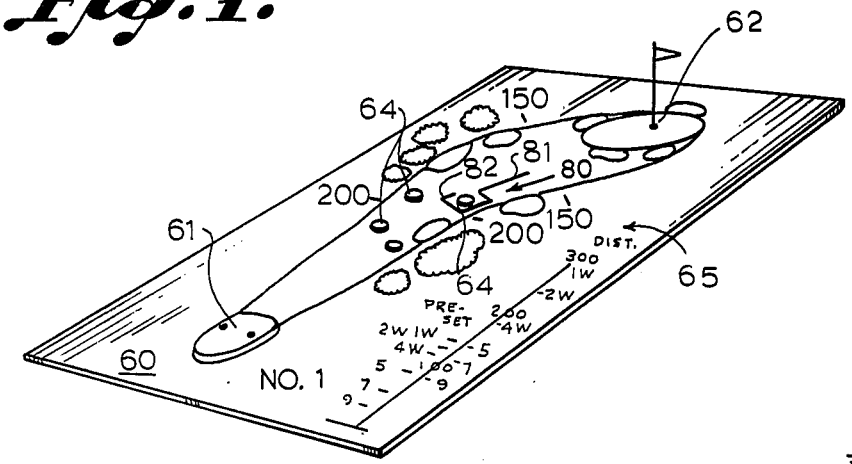
FIG. 1 illustrates the game board having several of the markers and other game devices thereon.

A game board, illustrated generally as 60 in FIG. 1, includes a section of a golf course comprising a tee-off point 61 and a hole point 62. The position of each of the players is denoted by a marker 64. A 200 yard mark from the tee and a 150 yard mark to the hole are marked along the edge of the fairway for assisting the golfer in planning the length of the shot required. Each of the holes of a normal 18 hole golf course will be represented by a separator game board 60. In this manner the same game elements may be used for playing on game boards corresponding to famous golf courses throughout the world.

Figure 3:
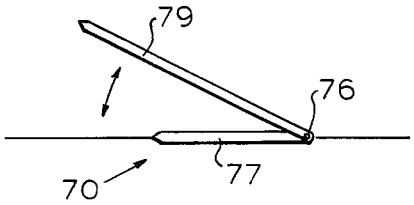
FIG. 3 illustrates the shot vector caliper.

A shot vector caliper 70 (or conversion means) is illustrated in FIG. 3 as comprising a shorter preferred direction element 77 and a longer actual direction element 79 coupled thereto about the pivot 76. The shot vector caliper 70 is utilized for measuring the lateral deflection angle by which the ball departs the striking position as determined by the operation of the shot direction indicator 40 or 50. With respect to the first preferred embodiment of the shot direction indicator 40 the preferred direction element 77 is aligned along the preferred direction line 47 and the actual direction element 79 is aligned along the horizontal shaft section 44, with the pivot 76 being coincident with the pivot 46. The shot vector caliper 70 is utilized in a similar manner with respect to the second preferred embodiment of the shot direction indicator 50. The vertical shaft 52 has been struck and lies on the floor as previously described. The preferred direction element 77 is laid on the cord 58 which has remained in line with preferred direction line 57, while at the same time placing pivot 76 at the pivot point of the two measuring cords. The actual direction element 79 is then moved around pivot 76 so that it lies on the measuring cord which extends over first end 51. Thus, the off-line angle of flight of the hypothetical golf ball has been transferred to the shot vector caliper 70.

A preferred direction selector, illustrated generally as 80 in FIG. 1, includes a generally rectangular shaped 82 enclosure for encircling the marker 64 of the player, and an extended rod 81 coupled thereto for illustrating the desired direction of flight of the hypothetical golf ball. For drives, fairway shots, and approach shots, the player places the enclosure 82 of the preferred direction selector 80 around his marker 64 and rotates the selector so that it points at the direction on the playing board 65 in which he wants his hypothetical ball to travel. This preferred direction may be right at the hole 62, or at a point on the playing area which will give the player the best position for his next shot.

The operation and use of the parlor golf simulation game will now be described with reference to FIGS. 1, 2, 3 and 4. A game board or sheet 60 marked hole No. 1 is placed on a table in the room where the game is to be played (Game Board No. 1 is replaced by Game Board No. 2 through Game Board No. 18 as the game progresses). Next, all of the markers 64 are located adjacent to the tee 61 of the first hole. The first player will then place his marker 64 on the tee and orient the preferred direction selector 80 over the marker and adjust the rod 81 to indicate his preferred direction for the flight of the hypothetical ball. Next, the first player will then select and grasp the handle 20 with the normal golf grip, making sure that the flexible line 30 is properly inserted through the handle aperture 24 and into the handle cavity 22. The first player then approximates the distance desired for the first golf shot, which is normally a long distance drive. The first player then locates the base 48 of the shot direction indicator 40 adjacent to his feet such that the expected direction of flight of the hypothetical golf ball hit during the subsequent stroke would follow the preferred direction line 47. The first player then orients the horizontal shaft section 44 along the preferred direction line 47. Next, the first player swings the handle 20 in the normal golfing swing. During this golf swing two separate indications will be obtained. First, the first end of the flexible line 30 will be pulled by centrifugal force through the handle aperture 24 from within the handle cavity 22 of the handle 20. Simultaneously during the swing, the hands of the first player, or the handle 20 being gripped by the first player, will contact the vertical shaft 42 of the shot direction indicator 40. This contact should be along a line parallel with the preferred direction line 47. If the first golfer's swing is from inside to outside, for example, then the contact with the vertical shaft 42 of the shot direction indicator 40 will not only cause a forward deflection of the vertical shaft 42, but will also cause a rotation of the horizontal shaft 44 about the pivot 46 in a generally clockwise direction for a right handed golfer.

After completion of the first player's golf swing, the preferred direction element 77 of the shot vector caliper 70 is located along the preferred direction line 47 of the base 48. Then, the actual direction element 79 of the shot vector caliper 70 is aligned with the horizontal shaft section 44 of the shot direction indicator 40, with the pivot 76 coincident with the pivot 46. The friction present in the pivot 76 will allow the shot vector caliper 70 to then be transferred to the game board 60 without a measurable change in the angle between the two elements. The preferred direction element 77 is placed along the rod 81 of the preferred direction selector 80. The selector 80 then is removed from the board, and the pivot 76 is moved to the approximate center position of marker 64. The marker 64 is then removed from the board. Next, the inside end 33 of the sheath 31 is placed adjacent to pivot 76 and the flexible line 30 is extended along the actual direction element 79 of the shot vector caliper 70. The length of the flexible line 30 between the inside end 33 and the handle aperture 24 is then extended along the actual direction element 79 by placing the flexible line 30 along that element. Then the marker 64 designating the first player is moved to a point adjacent the handle aperture 24.

In this manner each of the players sequentially takes his turn at hitting the hypothetical ball by swinging the handle 20 and striking the shot direction indicator 40 during the swing. Of course, as each of the players progresses closer to the hole 62, the player will reduce the length of his full backswing to a three quarter or one half backswing. Chip shots are accomplished with still shorter backswings and softer downswings. When a shot of the player lands on the putting surface surrounding the hole point 62, then that player may utilize an actual golf ball and putter club for putting the ball into a simulated hole in the game room. This type of simulated putting practice is well known in the art and therefore will not be described further herein.

Several changes in the normal golfing rules are required to accommodate the limitations of this game. For example, when a golfer's ball is hit into the woods it must be removed to the edge of a nearby fairway a point no closer to the hole than the original position before the next shot will be executed. Of course, a penalty shot is charged for this lateral movement of the ball. Also, the maximum length of a shot out of a sand trap as illustrated on the game board 60 will be 100 yards. Other exceptions from the normal rules of the game of golf may be included to suit the particular desires of the players or the demands and limitations of the playing area. The scoring of the simulated golf game is generally identical to the normal golf game.

Therefore, a first preferred embodiment of the present invention has been illustrated as an example of the invention as claimed. However, the present invention should not be limited in its application to the details and constructions illustrated in the accompanying drawings and specification, since this invention may be practiced or constructed in a variety of other different embodiments. Also, it must be understood that the terminology and descriptions employed herein are used solely for the purpose of describing the general process and the preferred embodiment, and therefore should not be construed as limitations on the operability of the present invention.

I claim:

1. A swing-form indicator comprising in combination:

an elongated handle for being grasped and swung by the player, said handle including a cavity formed therein;

a flexible line at least partially disposed within said cavity, whereby swinging said handle by the player may cause a segment of said flexible line to extend from said cavity away from said handle;

vector means responsive to the swinging of said handle, including said flexible line, for determining forward distance and direction components, said vector means comprising resistance means disposed in interconnecting relation between said flexible line and said handle cavity for allowing a length of said flexible line to pass therethrough as said handle is swung, whereby a said length passing through said resistance means is representative of said forward distance components, said vector means further comprising forward direction means for being struck by said handle during the swing, whereby the position of said forward direction means after being struck is representative of said forward direction component.

2. The swing-form indicator as described in claim 1 wherein said resistance means comprises a handle aperture in said handle for providing a known resistance to the passage of said flexible line therethrough.

3. The swing-form indicator as described in claim 2 wherein said length of said flexible line is stored within an elongated handle cavity within said handle, with a first end of said flexible line passing through said handle aperture for exiting said handle cavity.

4. The swing-form indictor as described in claim 3 wherein said handle aperture is located generally at one end of said handle.

5. The swing-form indicator as described in claim 4 wherein an effective cross-section of said flexible line is slightly larger than but generally concentric with an effective cross-section of said handle aperture.

6. The swing-form indicator as described in claim 4 further comprising additional mass means coupled to said first end of said flexible line for increasing the centrifugal force on said flexible line when said handle is swung.

7. The swing-form indicator as described in claim 6 further comprising guide means within said handle cavity for guiding the movement of said flexible line through said handle aperture, thereby preventing the formation of knots as said flexible line exits said handle aperture.

8. The swing-form indicator as described in claim 1 wherein said forward direction means comprises in combination:

a base;

a directional member having a flexible vertical section for being struck and deflected during the swing by said handle and further having a horizontal section coupled thereto for indicating a lateral component of the swing; and pivot means for movably coupling said directional member to said base, whereby said vertical section will be laterally deflected by a lateral component of the swing for producing a lateral component indication.

9. The swing-form indicator as described in claim 1 wherein said forward direction means comprises in combination:

a support;

a forward direction reference line attached to and extending generally in a straight line from said support in an extended direction; and a shaft releasably supported in a vertical position by said support for being struck during the swing by said handle and propelled generally along said forward direction line, whereby a lateral component indication of the swing is represented by the distance after landing of a reference point on said shaft with respect to said forward direction reference line.

10. The swing-form indicator as described in claim 9 further comprising in combination:

a game board representative of a section of a golf course including a tee-off point and a hole point spaced therefrom; and markers for representing the position of each player from which distance and direction are measured.

11. The swing-form indicator as described in claim 10 further comprising shot direction means for being placed on said game board adjacent one of said markers for representing a desired shot direction.

12. The swing-form indicator as described in claim 11 wherein said game board further comprises shot conversion means for indicating the movement of said marker with respect to said shot direction means responsive to said forward distance component and said forward direction component derived from the swing.

13. The swing-form indicator as described in claim 12 wherein said shot conversion means comprises:

a forward direction element for being aligned with said shot direction means; and a flight direction element pivotally coupled adjacent one end thereof to said forward direction element, and having a second end thereof movably spaced from said forward direction element by an angular distance representative of said lateral component indication.

14. A parlor game for simulating the sport of golf, said parlor game comprising in combination:

handle means for being grasped and swung by the player for measuring a centrifugal force generated by the swing representative of a shot distance indication;

forward direction means for being struck by said handle means during the swing for providing a shot direction indication of said shot distance indications;

a game board representative of a golf course including at least one tee-off point and one hole point thereon;

markers for representing the position of each player on said game board; and conversion means for converting said shot distance indication and said shot direction indication into a distance vector, whereby the shot by shot action of the game of golf may be simulated by moving said markers along said distance vector.

15. The golf parlor game as described in claim 14 wherein said handle means comprises in combination:

an elongated handle for being grasped and swung by the player, said elongated handle having a handle aperture therein and communicating with a handle cavity therewithin; and a flexible line stored within said handle cavity and slidably communicating through said handle aperture proportional to a centrifugal force generated by the handle swing whereby the length of said flexible line drawn from said handle aperture is proportional to said shot distance indication.

16. The golf parlor game as described in claim 15 wherein said handle aperture is located in a one end of said elongated handle and has an effective cross-section generally smaller than a cross-section of said flexible line for providing resistance to the longitudinal passage of said flexible line passing therethrough.

17. The golf parlor game as described in claim 16 wherein said forward direction means comprises in combination:

a support; and a flexible shaft supported in a vertical position by said support for being struck during the swing by said handle for being displaced in a direction generally parallel to the forward direction of the swing, whereby a lateral component indication of the swing is represented by the lateral displacement of the flexible shaft.

18. The golf parlor game as described in claim 17 wherein said conversion means comprises in combination;

a forward direction element for being aligned in a preferred direction from one of said markers to said hole point on said game board; and a flight direction element pivotally coupled adjacent one end thereof to said forward direction element and having a second end thereof spaced from said forward direction element by an angular distance representative of said lateral component indication, thereby indicating the vector direction of the sheet.

* * * * *